US005921197A

United States Patent [19]

Wagner

[11] Patent Number: 5,921,197

[45] Date of Patent: Jul. 13, 1999

[54] KEEL ELEMENTS FOR KAYAKS

[76] Inventor: William James Wagner, 238 Covina Ave., Long Beach, Calif. 90803

[21] Appl. No.: 09/061,934

[22] Filed: Apr. 17, 1998

[51] Int. Cl.[6] ..... B63B 35/00

[52] U.S. Cl. ..... 114/347; 114/140; 114/345

[58] Field of Search ..... 114/345, 347, 114/140, 141, 149; 441/40, 37

[56] References Cited

U.S. PATENT DOCUMENTS 4,556,006 12/1985 Kaupat ..... 114/347
4,915,047 4/1990 Lord et al. ..... 114/345

FOREIGN PATENT DOCUMENTS 431821 7/1926 Germany ..... 114/345

*Primary Examiner*—Jesus D. Sotelo
*Attorney, Agent, or Firm*—Lyon & Lyon LLP

[57] ABSTRACT

A keel system for an inflatable kayak which is a one-piece plate of plastic material defining a pressure plate at an upper end, a skeg at a lower end and an attachment portion therebetween. The attachment portion includes upper and lower engaging elements to cooperate with the web and a grommet of a typical inflatable kayak to lock the structure at the stern. A similar device with a keel strip extending rearwardly under the hull is provided at the bow of the kayak. A rudder may be pivotally mounted to the aft edge of a skeg and stern post portion and in turn receive an outboard motor. Locking plate may be extended perpendicularly across the tops of the pressure plates to cooperate with the gunwales and spray cover of the kayak.

24 Claims, 5 Drawing Sheets

KEEL ELEMENTS FOR KAYAKS

BACKGROUND OF THE INVENTION

The field of the present invention is equipment for inflatable boats.

Kayaks come in a wide variety of materials and structures including inflatable structures made of plastic sheet. Such kayaks are typically inflated and stressed to the point of being fairly rigid. They include an inflated hull with particular rigidity and structure provided by two elongate tubes which are bowed along their length and compressed together at their ends to form the gunwales. A web extends from the end of one inflated tube to the other at each end of the kayak. To create further kayak-like characteristics, spray covers are provided over and tie. to the ends of the hull. With the spray covers taut, the tubes at the ends are further held together. Under the cover and between the compressed ends of the tubes, a pinch exists which exerts a significant amount of force between the two tubes, given the area involved and the tube pressures.

Kayaks are relatively difficult to steer without practice. This can be particularly true of inflatable kayaks. Even so, structures providing significant directional stability for inflatable boats have not been available without significant complication.

SUMMARY OF THE INVENTION

The present invention is directed to a keel system for inflatable kayaks. A pressure plate is provided to one end of either a stern post or a stem post while a skeg or keel strip is provided at the other. The pressure plate may be positioned within the pinch between the two compressed ends of the kayak tubes. Engagement elements couple with the kayak while either a skeg or keel strip is presented at the lower end for directional stability of the craft.

Where greater directional control is desired, the keel system including a skeg may further include a pivotally mounted rudder. The rudder can in turn mount an outboard motor.

Accordingly, it is an object of the present invention to provide a system for improving directional stability for inflatable kayaks. Other and further objects and advantages will appear hereinafter.

DETAILED DESCRIPTION OF THE PREFERRED EMBODIMENT

Figure 1:
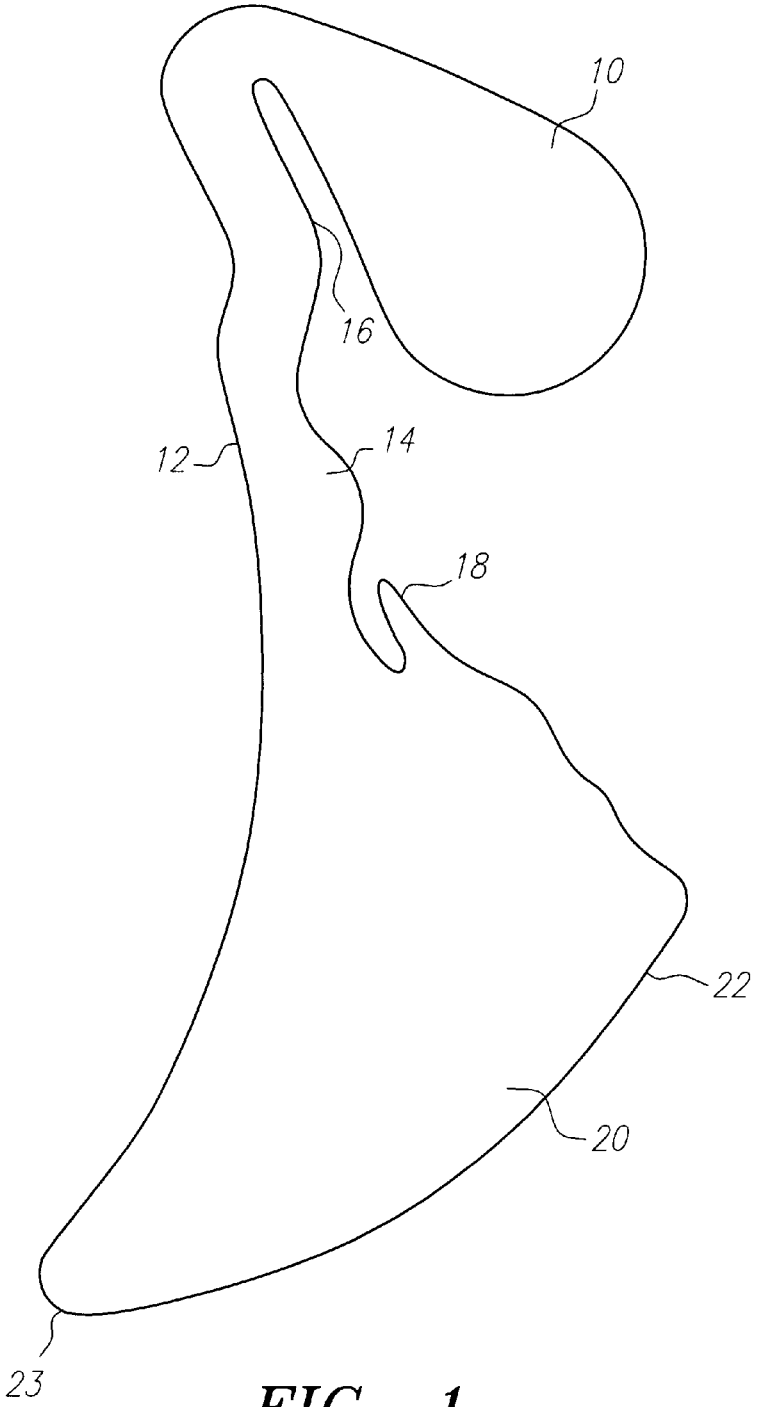
FIG. 1 is a side view of a keel including a skeg.
Figure 2:
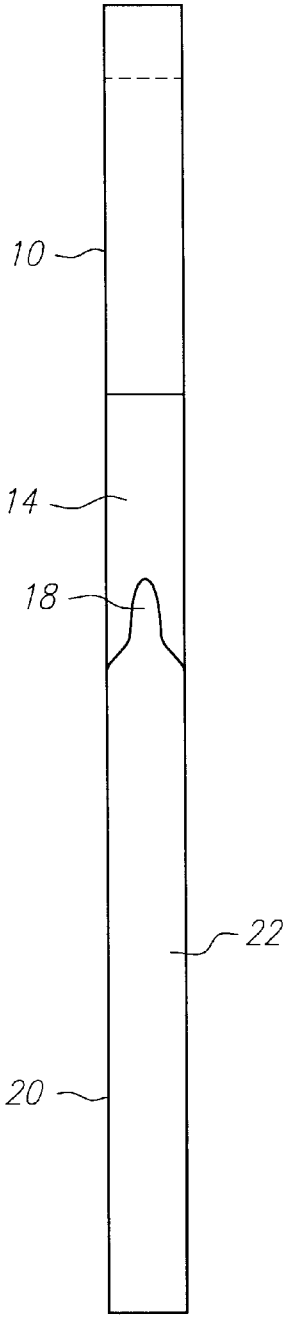
FIG. 2 is a front view of the device of FIG. 1.

Tuning to FIGS. 1 and 2, a keel system with a skeg is disclosed which is substantially passive in its operation. The keel system is conveniently a plate of significant rigidity to prevent unwanted oscillations in the water or to allow easy deflection. A plastic plate is most conveniently employed for the manufacture of the structure.

At the upper end, a pressure plate 10 extends forwardly from the main portion of the device. The pressure plate 10 includes a wide paddle structure for placement in the pinch between tubes in an inflatable kayak. The paddle like structure of the pressure plate 10 most advantageously extends across the anticipated area of pinch between the kayak tubes such that the pressure exerted by the tubes will accumulate all available force to retain the pressure plate 10 in place.

Attached to the pressure plate 10 is an attachment portion 12 which includes a stern post 14. This attachment portion 12 also includes an upper engaging element 16 which is defined between the stern post 14 and the pressure plate 10. The engagement element 16 defines a slot which extends upwardly from its opening. A lower engaging element 18 is defined as a pin which sticks upwardly from the forward edge of the stern post 14. The pin 18 is thin to receive a grommet conventionally found for tying lines to an inflatable kayak. Both the upper engagement element 16 and lower engaging element 18 are located on the same, forward edge of the stern post 14 in order that they might access the appropriate elements of a kayak.

A skeg 20 extends downwardly from the stern post 14 to which it is attached. As noted above, the skeg of FIGS. 1 and 2 is substantially passive, simply providing stability by its extension into the water. The leading edge 22 of the skeg 20 is curved rearwardly and downwardly relative to the kayak. This curvature enhances the ability of the device to remain free of entangling underwater vegetation, lines and trash. It further lessens the prospect of engagement with submerged rocks and other rigid structures. The extension of the skeg rearwardly to its lower terminus 23 increases the effective moment of the device in operating to enhance directional stability of a kayak.

Figure 3:
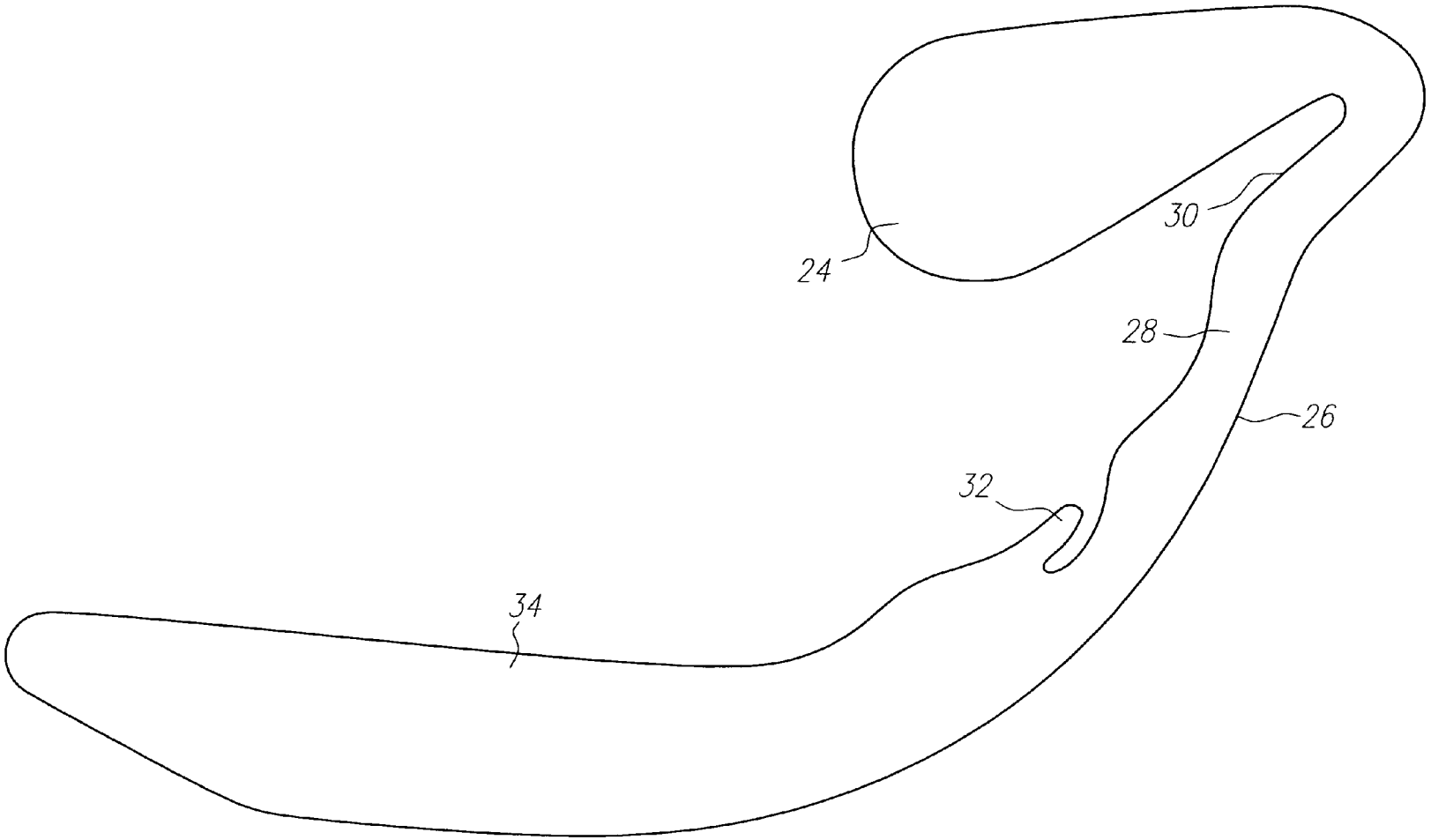
FIG. 3 is a side view of a keel including a keel strip.

Turning to FIG. 3, a second keel mechanism is illustrated. A pressure plate 24, much like the pressure plate 10, is designed with substantially the same considerations. An attachment portion 26 includes a stem post 28 which extends downwardly around the front of the keel. The attachment portion 26 further includes an upper engaging element 30 which defines a slot between the stem post 28 and the pressure plate 24. The attachment portion 26 further includes a lower engaging element 32 which is, again, a pin to cooperate with a convenient grommet typically located on inflatable kayaks. A keel strip 34 extends rearwardly on the kayak from the attachment portion 26. The keel strip lays up against the bottom of the hull. The upper and lower engaging elements 30 and 32 may be arranged relative to the pressure plate 24 and the keel strip 34 such that the keel strip 34 is retained against the hull. Typically a moment would be advantageously created drawing the lower engagement element toward the hull while forcing the upper engagement element 30 outwardly. The keel strip 34 also acts passively to create additional directional stability. The device of FIG. 3 is not shown on edge because it is also platelike and lying in a plane as ably demonstrated in FIG. 2 with respect to the first device.

Figure 4:
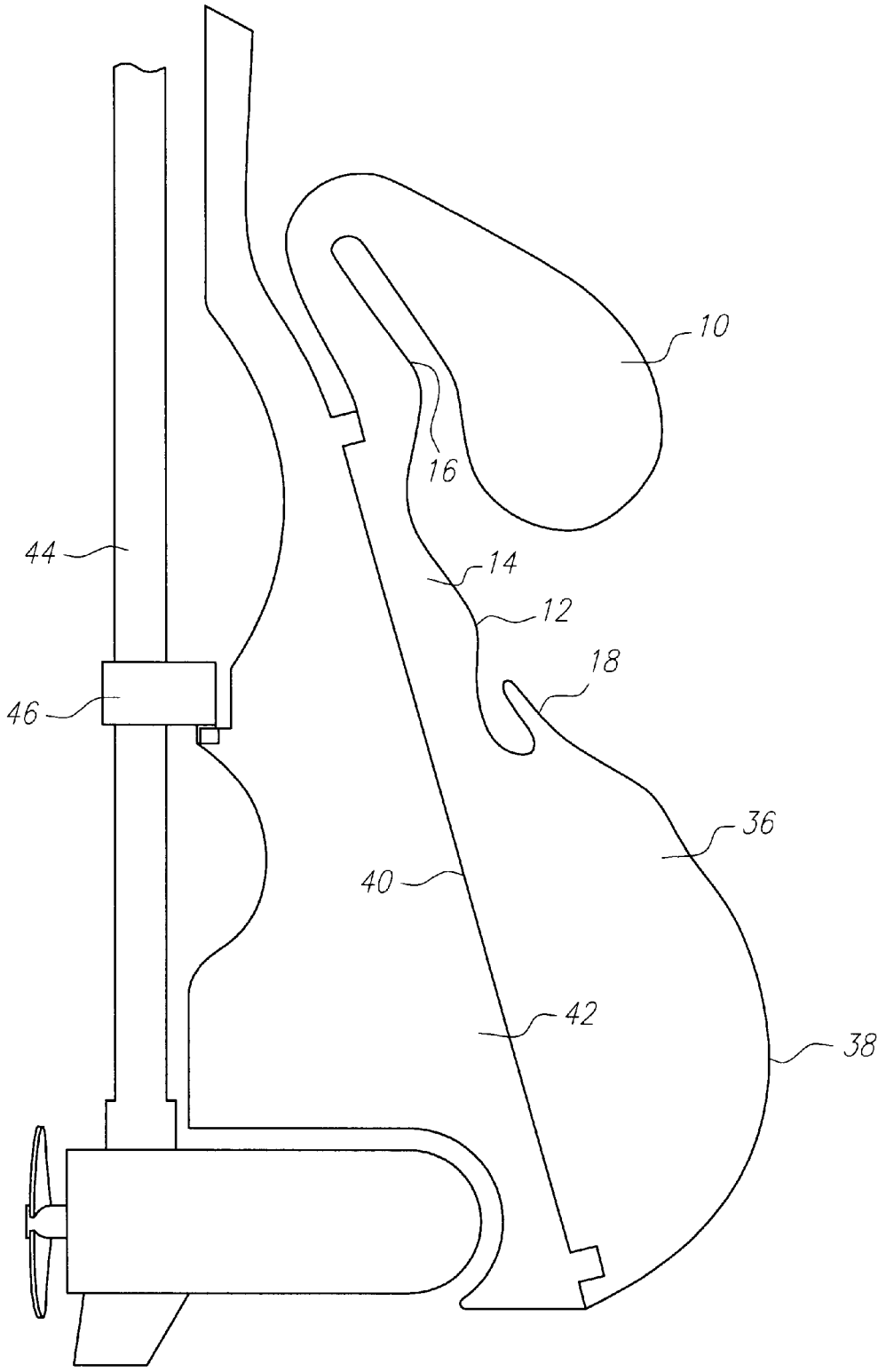
FIG. 4 is a side view of a rear keel system including a skeg, a pivotally mounted rudder and an outboard motor.

FIG. 4 illustrates a modified skeg and stern post portion for the pivotal attachment of a rudder. Again, the pressure plate 10 acts as before and defines an upper engagement slot 16 with the stern post 14 of the attachment portion 12. The lower engagement element 18 is also as before.

A skeg 36 extends downwardly from the attachment portion 12. The leading portion of the skeg is increased over that of the device of FIGS. 1 and 2. This leading portion 38 is also rounded to avoid submerged entanglements.

A trailing edge 40 is common to both the skeg 36 and the stern post 14 of the attachment portion 12. A rudder 42 is pivotally mounted to the skeg 36 adjacent the very bottom thereof and to the stern post 14. Pins (not shown) press fit into the skeg 36 and the stern post 14 and extend to receive the rudder 42. The pins pivotally mount the rudder 42 which may more freely engage the pins. Naturally, the rudder 42 extends rearwardly from the skeg 36. The rudder device also extends upwardly to above the body of an associated kayak such that a tiller (not shown) may be attached thereto. With the attachment of an outboard motor, a tiller on the rudder itself becomes unnecessary.

As illustrated, an outboard motor 44 may be attached by means of an attachment 46 to the rudder 42.

Figure 5:
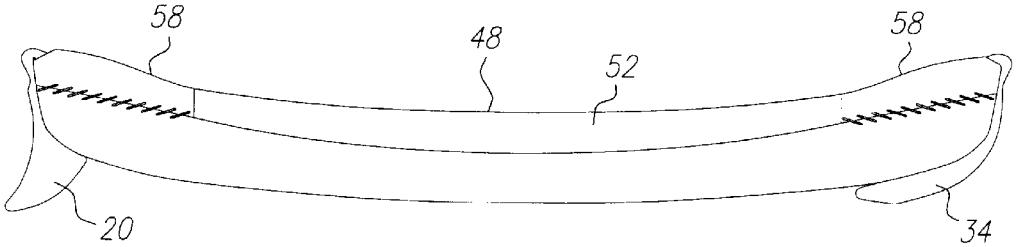
FIG. 5 is a side view of a kayak with a front keel system including a keel strip and a back keel system including a skeg.

FIGS. 5 through 8 illustrate the embodiments as positioned on an inflatable kayak. FIG. 5 illustrates the more passive skeg 20 as well as the keel strip 34. FIG. 6 again illustrates the keel strip 34 but also illustrates the mounting of the skeg 36 with the rudder 42 and an outboard motor 44.

Figure 7:
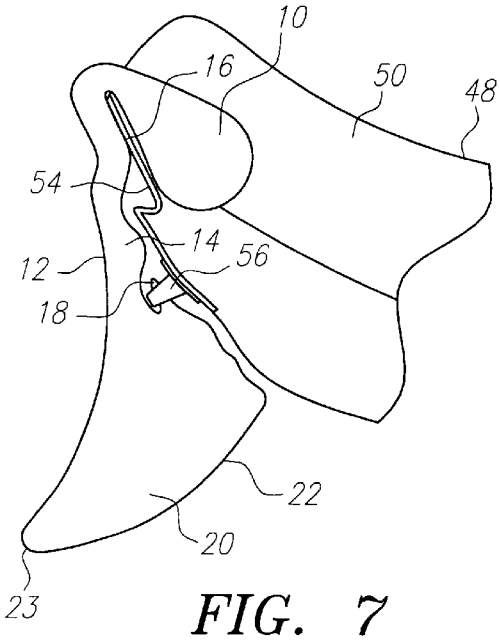
FIG. 7 is a cross section of a portion of a kayak illustrating the placement of a keel system with skeg.
Figure 8:
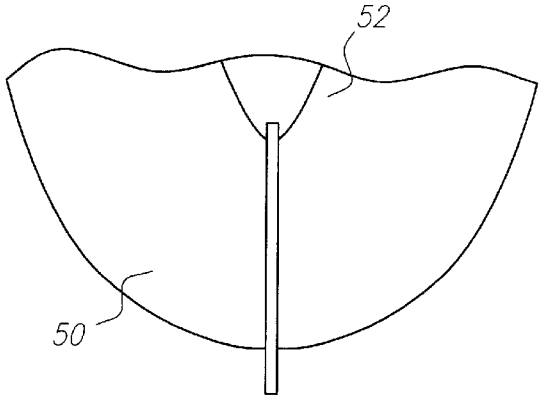
FIG. 8 is a plan view of one end of a kayak with a keel system in place.

Of interest is the FIG. 7 cross section and the FIG. 8 plan view of one end of a kayak 48. The gunwales of the kayak 48 include two inflatable tubes 50 and 52 which converge at either end and are bowed outwardly toward the center of the craft. The tubes 50 and 52 are compressed together at each end of the kayak 48 and held by webs 54 which extend from one tube to the other on the outside of the hull. As the tubes are inflated, the webs 54 carry a tension load which builds pressure between the tubes. Naturally, the placement of the pressure plate 10, 24 within the pinch created by these inflated tubes 50 and 52 and held together by a web 54 provides substantial force to retain the keel device in appropriate alignment.

Figure 6:
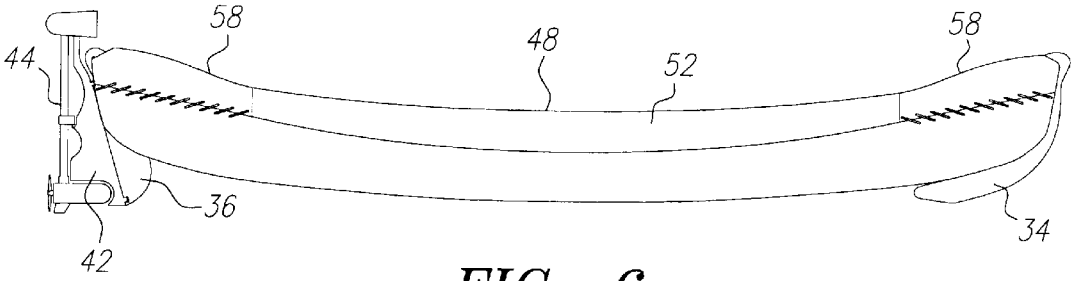
FIG. 6 is a side view of a kayak with a system of FIG. 4 in place.

The upper engaging element or slot 16 is shown to interact with the web 54 in FIG. 7. At the lower end of the stern post 14, the lower engaging element or pin 18 is shown to interact with a grommet 56. The relationship of the leading edge of the skeg 20 relative to the bottom of the hull of the kayak 48 is also well illustrated in FIG. 7. FIGS. 5 and 6 also illustrate the addition of spray covers 58 which are common components of such inflatable kayaks and further help to stabilize the ends thereof. Such covers 58 are provided over and tie to the ends of the hull. With the spray covers taut, the tubes at the ends are further held together. Under the cover and between the compressed ends of the tubes, a pinch exists which exerts a significant amount of force between the two tubes, given the area involved and the tube pressures.

Figure 9:
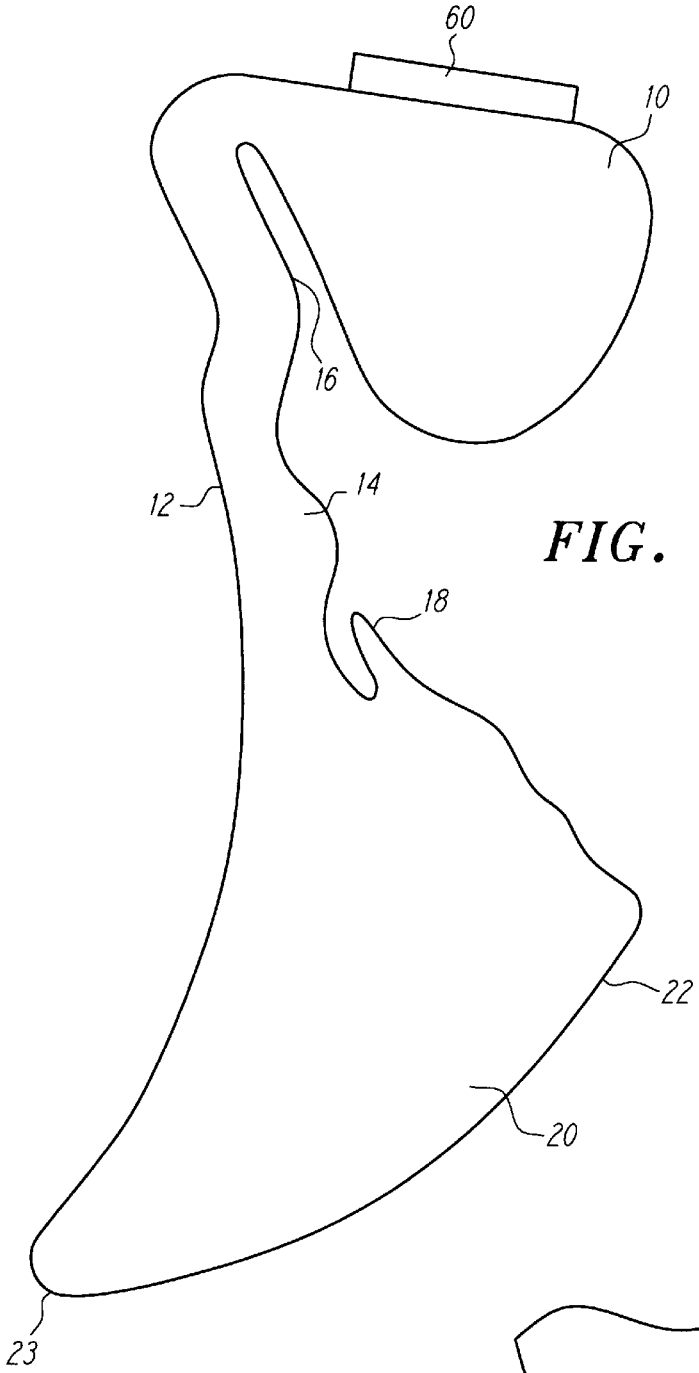
FIG. 9 is a side view of a keel including a skeg and a locking plate.
Figure 10:
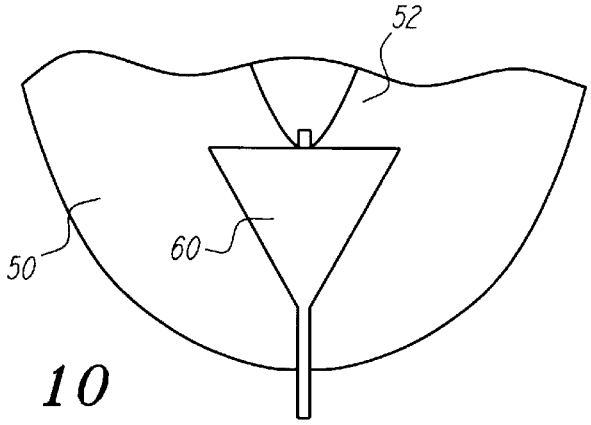
FIG. 10 is a top view of the device of FIG. 9 shown in position on a kayak.

FIGS. 9 and 10 illustrate an additional feature which is equally applicable to the embodiments of FIGS. 3 and 4. A locking plate 60 extends perpendicularly across the top of the pressure plate 10, the edge most distant from the stern post 14. The locking plate 60 is triangular in shape in the embodiment but could take other forms as well. The plate 60 may be of the same material as the sheet from which the remainder of the device is made and may be affixed by any number of conventional means or even molded with the remainder of the device. The locking plate 60 may be radiused if wear on the inflatable kayak becomes a problem or the size of the plate 60 increased to the same end. With the spray covers 58 in place, the locking plate 60 may bear against either the cover 58 in the upward direction or the tubes 50 and 52 in the downward direction to gain increased stability.

Accordingly, keel systems operable with inflatable kayaks are disclosed to the advantage of greater directional stability and control. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A keel for an inflatable kayak, comprising a skeg;

a pressure plate;

an attachment portion including a stern post, a first, upper engaging element and a second, lower engaging element, the first and second engaging elements being on one edge of the stern post, the skeg and the pressure plate being at opposite ends of the stern post.

2. The keel device of claim 1, the pressure plate and the skeg being relatively flat and lying in the same plane.

3. The keel device of claim 1, the upper engaging element including a slot extending away from the skeg from the open end thereof.

4. The keel device of claim 3, the slot being between the stern post and the pressure plate.

5. The keel device of claim 3, the lower engaging element including a pin extending toward the slot.

6. The keel device of claim 1, the lower engaging element including a pin extending toward the pressure plate.

7. The keel device of claim 1 being one piece of plastic sheet.

8. The keel device of claim 1 further comprising a rudder, the stern post and the skeg including a common trailing edge opposite to the edge with the first and second engaging elements thereon, the rudder being pivotally mounted to the trailing edge.

9. The keel device of claim 8, the rudder including an attachment for an outboard motor.

10. The keel device of claim 1 further comprising a locking plate extending perpendicularly to the pressure plate and located at the edge of the pressure plate most distant from the stern post.

11. A keel for an inflatable kayak, comprising a keel strip;

a pressure plate;

an attachment portion including a stem post, a first, upper engaging element and a second, lower engaging element, the first and second engaging elements being on one edge of the stem post, the keel strip and the pressure plate being at opposite ends of the stem post.

12. The keel device of claim 11, the pressure plate and the keel strip being relatively flat and lying in the same plane.

13. The keel device of claim 11, the upper engaging element including a slot extending away from the keel strip from the open end thereof.

14. The keel device of claim 13, the slot being between the stem post and the pressure plate.

15. The keel device of claim 13, the lower engaging element including a pin extending toward the slot.

16. The keel device of claim 11, the lower engaging element including a pin extending toward the pressure plate.

17. The keel device of claim 11 being one piece of plastic sheet.

18. The keel device of claim 11 further comprising a locking plate extending perpendicularly to the pressure plate and located at the edge of the pressure plate most distant from the stem post.

19. A kayak comprising a hull including two inflatable tubes converging at the ends, webs extending across the ends of the inflatable tubes, respectively, and a grommet below the ends of the tubes;

a skeg;

an attachment portion including a stern post, a first, upper engaging element and a second, lower engaging element, the first and second engaging elements being on one edge of the stern post, the first engaging element including a slot extending away from the skeg from the open end thereof and being hooked over the web, the second engaging element including a pin extending through the grommet;

a pressure plate, the skeg and the pressure plate being at opposite ends of the stern post, the pressure plate extending to between the ends of the two tubes compressed together.

20. The kayak of claim 19 further comprising a rudder, the stern post and the skeg including a common trailing edge opposite to the edge with the first and second engaging elements thereon, the rudder being pivotally mounted to the trailing edge of the skeg and the trailing edge of the stern post.

21. The kayak of claim 19, the rudder including an attachment for an outboard motor.

22. The kayak of claim 19 further comprising a keel strip;

a keel pressure plate;

a keel attachment portion including a keel stem post, a first, upper engaging keel element and a second, lower engaging keel element, the first and second engaging keel elements being on one edge of the keel stem post, the keel strip and the keel pressure plate being at opposite ends of the keel stem post.

23. The keel device of claim 22 further comprising a first locking plate extending perpendicularly to the pressure plate and located at the edge of the pressure plate most distant from the stern post;

a second locking plate extending perpendicularly to the pressure plate and located at the edge of the pressure plate most distant from the stem post.

24. The keel device of claim 19 further comprising a locking plate extending perpendicularly to the pressure plate and located at the edge of the pressure plate most distant from the stern post.

* * * * *